US011492759B2

(12) United States Patent
Wakabayashi

(10) Patent No.: US 11,492,759 B2
(45) Date of Patent: Nov. 8, 2022

(54) FIBER BODY FORMING METHOD AND SHEET

(71) Applicant: SEIKO EPSON CORPORATION, Tokyo (JP)

(72) Inventor: Shigemi Wakabayashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 183 days.

(21) Appl. No.: 16/893,530

(22) Filed: Jun. 5, 2020

(65) Prior Publication Data

US 2020/0385930 A1 Dec. 10, 2020

(30) Foreign Application Priority Data

Jun. 7, 2019 (JP) ..... JP2019-107076

(51) Int. Cl.

| | |
|---|---|
| ***D21H 21/06*** | (2006.01) |
| ***D21H 17/57*** | (2006.01) |
| ***D21H 23/50*** | (2006.01) |
| ***D21H 23/24*** | (2006.01) |
| ***D21H 23/04*** | (2006.01) |
| ***D21H 17/53*** | (2006.01) |

(52) U.S. Cl.

CPC ..... *D21H 21/06* (2013.01); *D21H 17/53* (2013.01); *D21H 17/57* (2013.01); *D21H 23/04* (2013.01); *D21H 23/24* (2013.01); *D21H 23/50* (2013.01)

(58) Field of Classification Search

CPC ..... D21H 21/06; D21H 17/53; D21H 17/57; D21H 23/04; D21H 23/24; D21H 23/50; D21H 19/62; D21H 25/06; D21H 19/56

See application file for complete search history.

(56) References Cited

U.S. PATENT DOCUMENTS

| | | | | |
|---|---|---|---|---|
| 2007/0286970 | A1* | 12/2007 | Ogino | G03G 7/008 428/32.21 |
| 2019/0062998 | A1* | 2/2019 | Chen | D21H 11/18 |
| 2019/0232606 | A1* | 8/2019 | Ota | D04H 1/54 |

FOREIGN PATENT DOCUMENTS

JP 2007-333794 A 12/2007

* cited by examiner

*Primary Examiner* — Eric Hug
*Assistant Examiner* — Matthew M Eslami
(74) *Attorney, Agent, or Firm* — Global IP Counselors, LLP

(57) ABSTRACT

A fiber body forming method includes a step of defibrating a raw material containing fibers to form a defibrated material; a step of depositing the defibrated material to form a web; a step of applying a liquid containing a thermoplastic resin which binds the fibers to the web; and a step of heating the web to which the liquid is applied to form a fiber body, and in the method described above, the fiber body has a storage elastic modulus of 600 MPa or more at 100° C. and a storage elastic modulus of 400 MPa or more at 150° C.

6 Claims, 3 Drawing Sheets

FIG. 4

| | | EXAMPLE 1 | EXAMPLE 2 | EXAMPLE 3 | EXAMPLE 4 | EXAMPLE 5 | COMPARATIVE EXAMPLE 1 | COMPARATIVE EXAMPLE 2 | COMPARATIVE EXAMPLE 3 |
|---|---|---|---|---|---|---|---|---|---|
| COMPONENT | RESIN 1 | 10 | – | – | 20 | 20 | – | – | – |
| | RESIN 2 | – | 10 | – | – | – | – | – | – |
| | RESIN 3 | – | – | 10 | – | – | – | – | – |
| | RESIN 4 | – | – | – | – | – | 10 | – | – |
| | RESIN 5 | – | – | | – | – | – | 10 | – |
| | RESIN 6 | – | – | | – | – | – | – | 3 |
| | GLYCERIN | 10 | 10 | 10 | 10 | – | 10 | 10 | 10 |
| | PROPYLENE GLYCOL | 10 | 10 | 10 | 10 | – | 10 | 10 | 10 |
| | OLFINE E1010 | 1 | 1 | 1 | 1 | – | 1 | 1 | 1 |
| | SURFYNOL 104PG50 | 0.5 | 0.5 | 0.5 | 0.5 | – | 0.5 | 0.5 | 0.5 |
| GLASS TRANSITION TEMPERATURE (°C) | | 101 | 75 | 80 | 101 | 101 | 40 | 103 | 120 |
| VISCOSITY (mPa·s) | | 7.5 | 8.3 | 9.1 | 13.8 | – | 9.8 | 8.9 | 14.1 |
| AVERAGE PARTICLE DIAMETER (nm) | | 30 | 10 | 44 | 30 | 16500 | 160 | 100 | – |
| STORAGE ELASTIC MODULUS AT 100°C (MPa) | | 670 | 621 | 635 | 670 | 696 | 355 | 620 | 537 |
| STORAGE ELASTIC MODULUS AT 150°C (MPa) | | 450 | 409 | 421 | 450 | 487 | 230 | 289 | 423 |
| CURLING PROPERTY | | A | A | A | A | A | B | B | B |
| INK JET APPLICABILITY | | A | A | A | B | – | A | A | A |

FIBER BODY FORMING METHOD AND SHEET

The present application is based on, and claims priority from JP Application Serial Number 2019-107076, filed Jun. 7, 2019, the disclosure of which is hereby incorporated by reference herein in its entirety.

BACKGROUND

1. Technical Field

The present disclosure relates to a fiber body forming method and a sheet.

2. Related Art

A fiber body forming method which forms a fiber body by binding fibers together with a thermoplastic resin has been known.

In addition, for example, JP-A-2007-333794 has disclosed a paper making technique in which in recording paper manufactured by a so-called wet method using a pulp dispersion liquid, cellulose pulps are bound together with β-1,3-glucan as a thermosetting material so as to form paper which is not likely to curl.

However, among fiber bodies in which fibers are bound together with a thermoplastic resin, depending on a resin material used for binding, some fiber body may be liable to curl in some cases. In addition, when fibers are bound together using, for example, β-1,3-glucan, which is a thermosetting material, disclosed in JP-A-2007-333794, compared to the binding between fibers with a thermoplastic resin, it may be difficult in some cases to again disentangle the fibers thus bound together.

SUMMARY

According to an aspect of the present disclosure, there is provided a fiber body forming method comprising: a step of defibrating a raw material containing fibers to form a defibrated material; a step of depositing the defibrated material to form a web; a step of applying a liquid containing a thermoplastic resin which binds the fibers to the web; and a step of heating the web to which the liquid is applied to form a fiber body, and in the method described above, the fiber body has a storage elastic modulus of 600 MPa or more at 100° C., and the fiber body has a storage elastic modulus of 400 MPa or more at 150° C.

In the fiber body forming method according to the above aspect, in the step of applying a liquid, the liquid may be applied by an ink jet method.

In the fiber body forming method according to the above aspect, the liquid may have a viscosity of 5.0 to 10.0 mPa·s at 25° C.

In the fiber body forming method according to the above aspect, the thermoplastic resin may have an average particle diameter of 100 nm or less in the liquid, and the content of the thermoplastic resin in the liquid may be 5 to 15 percent by mass.

According to another aspect of the present disclosure, there is provided a fiber body forming method comprising: a step of defibrating a raw material containing fibers to form a defibrated material; a step of mixing the defibrated material and a thermoplastic resin which binds the fibers to form a mixture; a step of depositing the mixture to form a web; and a step of heating the web to form a fiber body, and in the method described above, the fiber body has a storage elastic modulus of 600 MPa or more at 100° C., and the fiber body has a storage elastic modulus of 400 MPa or more at 150° C.

In the fiber body forming method according to the above another aspect, the thermoplastic resin may have a glass transition temperature of 75° C. to 120° C.

In the fiber body forming method according to the above another aspect, the thermoplastic resin may be selected from a polyurethane and a polyester.

According to another aspect of the present disclosure, there is provided a sheet containing a thermoplastic resin in an amount of 3 to 40 percent by mass, and the sheet has a storage elastic modulus of 600 MPa or more at 100° C. and a storage elastic modulus of 400 MPa or more at 150° C.

In the sheet according to the above another aspect, the thermoplastic resin may have a glass transition temperature of 75° C. to 120° C.

In the sheet according to the above another aspect, the thermoplastic resin may be selected from a polyurethane and a polyester.

BRIEF DESCRIPTION OF THE DRAWINGS

FIG. 4 is a table showing components of Examples 1 to 5 and Comparative Examples 1 to 3 and evaluation results thereof.

DESCRIPTION OF EXEMPLARY EMBODIMENTS

Hereinafter, preferable embodiments of the present disclosure will be described in detail with reference to the drawings. In addition, the following embodiments do not unreasonably limit the content of the present disclosure described in the claims. In addition, all the structures described below are not always required to be necessary constituent elements of the present disclosure.

1. Fiber Body Forming Method According to First Embodiment

Figure 1:
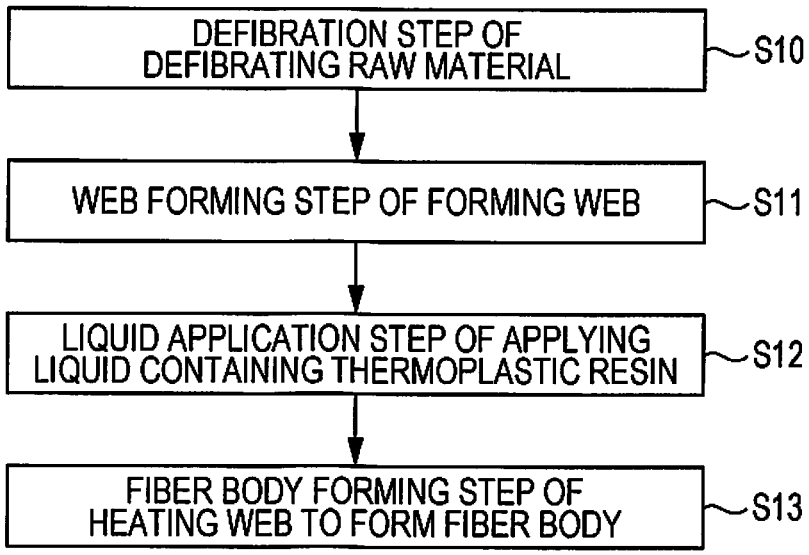
FIG. 1 is a flowchart illustrating a fiber body forming method according to a first embodiment.

First, a fiber body forming method according to a first embodiment will be described with reference to the drawing. FIG. 1 is a flowchart illustrating the fiber body forming method according to the first embodiment.

As shown in FIG. 1, the fiber body forming method according to the first embodiment comprises: a defibration step (Step S10) of defibrating a raw material containing fibers to form a defibrated material; a web forming step (Step S11) of depositing the defibrated material to form a web; a liquid application step (Step S12) of applying a liquid containing a thermoplastic resin which binds the fibers to the web; and a fiber body forming step (Step S13) of heating the web to which the liquid is applied to form a fiber body. Hereinafter, the fiber body forming method will be described below in accordance with the order of the steps.

1.1. Defibration Step 1.1.1. Raw Material

The raw material is a raw material to form a fiber body. As the raw material, for example, there may be mentioned waste paper, a pulp sheet, tissue paper, kitchen paper, a cleaner, a filter, a liquid absorber, a sound absorber, a buffer material, a mat, or a cardboard.

The raw material contains fibers. The fibers contained in the fiber body are, for example, cellulose fibers. As the cellulose fibers, for example, natural cellulose fibers or chemical cellulose fibers may be mentioned. In more particular, as the cellulose fibers, for example, cellulose fibers formed from a cellulose, a cotton, a hemp, a kenaf, a flax, a ramie, a jute, a Manila hemp, a Sisal hemp, a coniferous tree, or a broadleaf tree may be mentioned; those cellulose fibers may be used alone, or at least two types thereof may be used in combination; and those cellulose fibers may be used as regenerated cellulose fibers after being refined or the like. In addition, the cellulose fibers may be dried, may contain a liquid, such as water or an organic solvent, or may be impregnated therewith. Furthermore, the cellulose fibers may be processed by various types of surface treatments.

When the fibers contained in the raw material are each regarded as an independent fiber, the average diameter thereof is, for example, 1.0 to 1,000.0 μm and is preferably 5.0 to 100.0 μm. Although the length of the fiber is not particularly limited, as one independent fiber, a length of the fiber along a longitudinal direction is, for example, 1.0 μm to 5.0 mm.

1.1.2. Defibration

In the defibration step, the raw material is defibrated. In this case, the "defibrate" indicates that the raw material formed of fibers bound to each other is disentangled into separately independent fibers. The defibrated material thus defibrated may be not entangled with other defibrated fibers, that is, may be independently present or may be entangled with other defibrated materials to form aggregates, that is, may be present in the form of damas.

A material defibrated in the defibration step is called a "defibrated material". In the "defibrated material", besides the fibers thus disentangled, resin particles; coloring materials, such as an ink and a toner; and additives, such as a blurring inhibitor and a paper reinforcing agent, each of which is separated from the fibers when the fibers are disentangled, may also be contained in some cases.

The defibration step is performed by a dry method. A treatment, such as defibration, which is performed not in a liquid, such as water, but in a gas, such as the air, is called a dry type. Although not particularly limited, for example, the defibration step is performed using an impeller mill.

1.2. Web Forming Step 1.2.1. Deposition

In the web forming step, the defibrated material is deposited. As a deposition method, although the defibrated material may be deposited by a sieve, the method is not particularly limited. For example, although the defibrated material may be deposited on a transport belt, such as a mesh belt, an object onto which the defibrated material is to be deposited is not particularly limited.

1.2.2. Web

The web is a material in which fibers are not bound with a thermoplastic resin. The web contains a large amount of air and is softly expanded thereby. The thickness of the web is, for example, 0.5 to 30.0 mm and preferably 1.0 to 20.0 mm. The bulk density of the web is, for example, 0.01 to 0.50 g/cm$^3$ and preferably 0.02 to 0.20 g/cm$^3$.

1.3. Liquid Application Step 1.3.1. Liquid

The liquid contains a thermoplastic resin. The thermoplastic resin contained in the liquid binds the fibers contained in the fiber body. In this embodiment, the "thermoplastic resin binds the fibers" indicates a state in which particles of the thermoplastic resin are disposed between the fibers, and the fibers are not likely to be separated from each other due to the thermoplastic resin interposed therebetween. The liquid is a resin emulsion containing a thermoplastic resin.

As the thermoplastic resin contained in the liquid, for example, there may be mentioned a polyurethane, a polyester, an AS resin, an ABS resin, a polypropylene, a polyethylene, a poly(vinyl chloride), a polystyrene, an acrylic resin, a poly(ethylene terephthalate), a poly(phenylene ether), a poly(butylene terephthalate), a nylon, a polyamide, a polycarbonate, a polyacetate, a poly(phenylene sulfide), or a poly(ether ether ketone). In particular, as the thermoplastic resin, a polyurethane or a polyester is preferably selected. Solubility parameter (SP) values of a polyurethane and a polyester are 10.0 to 11.0, a SP value of an acrylic resin is 9.0 to 9.5, and a SP value of cellulose fibers is 15.6. Incidentally, since the SP value is a parameter indicating the solubility and/or the compatibility of a substance, values close to each other indicate a high compatibility, that is, a high affinity, between two substances, and values apart from each other indicates a low affinity therebetween. Since the SP values of a polyurethane and a polyester are each close to that of cellulose fibers as compared to the SP value of an acrylic resin, a polyurethane or a polyester has a high affinity to cellulose fibers and is likely to bind the fibers. Furthermore, since the affinity to cellulose fibers is high, dynamic characteristics of cellulose fibers can be modified, and as a result, the storage elastic modulus of the fiber body can be enhanced.

A glass transition temperature Tg of the thermoplastic resin contained in the liquid is, for example, 75° C. to 120° C. and preferably 80° C. to 101° C. When the Tg is 75° C. or more, the storage elastic modulus of the fiber body can be increased. When the Tg is 120° C. or less, an energy load to form the fiber body can be reduced, and as a result, a reduction in size of a fiber body forming apparatus and a reduction in cost can be achieved.

The shape of the thermoplastic resin contained in the liquid is, for example, particles. As long as being particles, the thermoplastic resin may have a spherical shape, a shape having an oval cross-section, or a shape having a polygonal cross-section. The average particle diameter of the thermoplastic resin in the liquid is, for example, 100 nm or less, preferably 50 nm or less, and more preferably 44 nm or less. When the average particle diameter of the thermoplastic resin in the liquid is 100 nm or less, the fiber surfaces can be sufficiently covered with the thermoplastic resin. In addition, the "average particle diameter" indicates the D50. The average particle diameter is measured, for example, by a light scattering method.

The content of the thermoplastic resin contained in the liquid is, for example, 5 to 20 percent by mass and preferably 5 to 15 percent by mass. When the content of the thermoplastic resin in the liquid is 5 percent by mass or more, a sufficient amount of the thermoplastic resin can be secured so as to bind the fibers. When the content of the thermoplastic resin in the liquid is 15 percent by mass or less, since the viscosity of the liquid is not excessively increased, the liquid can be easily applied by an ink jet method.

The viscosity of the liquid at 25° C. is, for example, 5.0 to 15.0 mPa·s, preferably 5.0 to 10.0 mPa·s, and more preferably 7.5 to 9.1 mPa·s. When the viscosity of the liquid at 25° C. is 5.0 to 10.0 mPa·s, the liquid can be easily applied by an ink jet method. Furthermore, the liquid is likely to penetrate deeply in the web, and hence, the elastic modulus and the breaking strength of the fiber body can be increased.

Besides the thermoplastic resin, the liquid contains water. The liquid may further contain a penetrant and/or a moisturizer.

As the penetrant, for example, there may be mentioned a glycol ether, such as triethylene glycol monobutyl ether, triethylene glycol dimethyl ether, triethylene glycol diethyl ether, triethylene glycol dibutyl ether, or triethylene glycol methyl butyl ether; a silicone-based surfactant, an acetylene glycol-based surfactant, an acetylene alcohol-based surfactant, or a fluorine-based surfactant. The liquid may contain one of the penetrants mentioned above or at least two thereof.

As the moisturizer, for example, there may be mentioned diethylene glycol, triethylene glycol, propylene glycol, dipropylene glycol, 1,3-propanediol, 1,3-butylene glycol, 1,4-butanediol, 1,5-pentanediol, 1,6-hexanediol, 2-ethyl-2-methyl-1,3-propanediol, 2-methyl-2-propyl-1,3-propanediol, 2-methyl-1,3-propanediol, 2,2-dimethyl-1,3-propanediol, 3-methyl-1,3-butanediol, 1,2-hexanediol, 2-ethyl-1,3-hexanediol, 3-methyl-1,5-penetandiol, 2-methylpenetane-2,4-diol, trimethylolpropane, or glycerin. The liquid may contain one of the moisturizers mentioned above or at least two thereof.

1.3.2. Application

In the liquid application step of applying a liquid, for example, the liquid is applied by an ink jet method. Accordingly, the liquid can be uniformly applied on the web. In particular, the liquid is applied by an ink jet printer. In addition, the method for applying a liquid is not limited to the ink jet method, and for example, the liquid may be applied by a spray method.

1.4. Fiber Body Forming Step 1.4.1. Heating

The thermoplastic resin is melted or softened by heating, and hence, the fibers are bound together. By this step, the fiber body as a molded material can be formed. The heating is performed, for example, by a heating roller machine, a heat press device, or a three-dimensional molding machine. A heating temperature is appropriately determined, for example, in consideration of the type of thermoplastic resin and the like.

1.4.2. Fiber Body

The fiber body is formed by the fiber body forming method described above and is a sheet in which fibers are bound with a thermoplastic resin.

The storage elastic modulus of the fiber body at 100° C. is 600 MPa or more and preferably 621 MPa or more. The storage elastic modulus of the fiber body at 150° C. is 400 MPa or more and preferably 409 MPa or more. When the storage elastic modulus of the fiber body at 100° C. is 600 MPa or more and 400 MPa or more at 150° C., the rigidity of the fiber body in a high temperature environment can be secured, and when the fiber body is printed, curling is not likely to occur.

The storage elastic modulus of the fiber body is, for example, 5,000 MPa or less. When the storage elastic modulus of the fiber body is more than 5,000 MPa, the flexibility of the sheet is degraded, and the feeling of use thereof becomes inferior. When the storage elastic modulus of the fiber body is 5,000 MPa or less, the problem as described above can be avoided.

The content of thermoplastic resin in the fiber body is 3 to 40 percent by mass. When the content of the thermoplastic resin in the fiber body is 3 to 40 percent by mass, the fiber body can be regarded as a material formed by recycling a raw material such as waste paper. Even if a sheet which is not formed by recycling a raw material such as waste paper contains a thermoplastic resin, the content of the thermoplastic resin is not in a range of 3 to 40 percent by mass. The content of the thermoplastic resin contained in the fiber body can be measured by a thermal gravimetric analysis (TGA).

1.5. Other Steps

The fiber body forming method according to the first embodiment may further comprise at least one step other than the defibration step, the web forming step, the liquid application step, and the fiber body forming step.

The fiber body forming method according to the first embodiment may comprise a pressure application step of applying a pressure to the web to which the liquid is applied. By the pressure application step, the bulk density of the web can be increased. The pressure application step may be performed before the web is heated. In the pressure application step, for example, the web may be pressurized by a calendar roller machine, a press device, or the like.

1.6. Effects

The fiber body forming method according to the first embodiment has, for example, the following effects.

In the fiber body forming method according to the first embodiment, the storage elastic modulus of the fiber body at 100° C. is 600 MPa or more, and the storage elastic modulus of the fiber body at 150° C. is 400 MPa or more. Hence, the rigidity of the fiber body in a high temperature environment can be secured, and as described in the following "5. EXAMPLES AND COMPARATIVE EXAMPLES", when the fiber body is printed, curling is not likely to occur. Furthermore, in the fiber body forming method according to the first embodiment, since the thermoplastic resin is used to bind the fibers, compared to the case in which a thermosetting resin is used, the fibers bound together can be easily again disentangled from each other. Hence, the fiber body is likely to be recycled.

In the fiber body forming method according to the first embodiment, in the liquid application step of applying a liquid, the liquid may be applied by an ink jet method. Accordingly, the liquid can be uniformly applied on the web.

In the fiber body forming method according to the first embodiment, the viscosity of the liquid at 25° C. may be 5.0 to 10.0 mPa·s. Accordingly, by an ink jet method, the liquid can be easily applied. Furthermore, the liquid is likely to penetrate deeply in the web, and hence, the elastic modulus and the breaking strength of the fiber body can be increased.

In the fiber body forming method according to the first embodiment, the average particle diameter of the thermoplastic resin in the liquid may be 100 nm or less, and the content of the thermoplastic resin in the liquid may be 5 to 15 percent by mass. Accordingly, the fiber surfaces can be sufficiently covered with the thermoplastic resin. Furthermore, while the amount of the thermoplastic resin is secured, the liquid can be easily applied by an ink jet method.

In the fiber body forming method according to the first embodiment, the glass transition temperature of the thermoplastic resin may be 75° C. to 120° C. Accordingly, at 100° C. or more, while the storage elastic modulus of the fiber body is increased, the energy load to form the fiber body can be reduced.

In the fiber body forming method according to the first embodiment, the thermoplastic resin may be selected from a polyurethane and a polyester. Accordingly, the affinity between the thermoplastic resin and the fibers can be increased, and hence, the fibers are likely to be bound together. Furthermore, the storage elastic modulus of the fiber body can be increased.

2. Fiber Body Forming Method According to Second Embodiment

Figure 2:
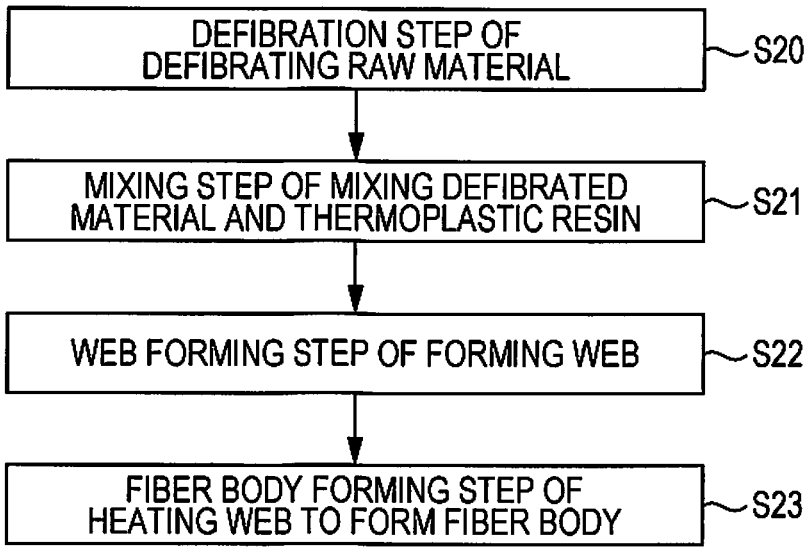
FIG. 2 is a flowchart illustrating a fiber body forming method according to a second embodiment.

Next, a fiber body forming method according to a second embodiment will be described with reference to the drawing. FIG. 2 is a flowchart illustrating the fiber body forming method according to the second embodiment.

Hereinafter, in the fiber body forming method according to the second embodiment, points different from those of the example of the fiber body forming method according to the first embodiment will be described, and description of points similar to those thereof will be omitted.

In the fiber body forming method according to the second embodiment, a liquid containing a thermoplastic resin is not used, and a thermoplastic resin powder is used. The fiber body forming method according to the second embodiment comprises, as shown in FIG. 2, a defibration step (Step S20) of defibrating a raw material containing fibers to form a defibrated material; a mixing step (Step S21) of mixing the defibrated material and a thermoplastic resin which binds the fibers to form a mixture; a web forming step (Step S22) of depositing the mixture to form a web; and a fiber body forming step (Step S23) of heating the web to form a fiber body.

In the mixing step, the defibrated material and the thermoplastic resin are mixed together. "The defibrated material and the thermoplastic resin are mixed together" includes a case in which the defibrated material and the thermoplastic resin are uniformly mixed together and a case in which although not being uniformly mixed together, the defibrated material and the thermoplastic resin are brought into contact with each other and are mixed together so as to be able to form a fiber body. Although an apparatus for mixing the defibrated material and the thermoplastic resin is not particularly limited, for example, a blender, a mixer, a screw feeder, or a disc feeder may be mentioned.

In the mixing step, to the thermoplastic resin, the description of the thermoplastic resin in the above "1.3.1. LIQUID" can be applied. However, a liquid containing the thermoplastic resin is not used, and a thermoplastic resin powder is used.

The average particle diameter of the thermoplastic resin in the fiber body forming method according to the second embodiment is larger than the average particle diameter of the thermoplastic resin in the fiber body forming method according to the first embodiment. The average particle diameter of the thermoplastic resin in the fiber body forming method according to the second embodiment is, for example, 10 to 20 μm and preferably 15 to 18 μm.

In the web forming step, the mixture of the defibrated material and the thermoplastic resin is deposited to form a web. That is, in the web, the same type of thermoplastic resin as that described in "1.3.1. LIQUID" is contained.

In the fiber body forming method according to the second embodiment, since the storage elastic modulus of the fiber body at 100° C. is 600 MPa or more, and the storage elastic modulus of the fiber body at 150° C. is 400 MPa or more, as is the fiber body forming method according to the first embodiment, when the fiber body is printed, curling is not likely to occur.

3. Fiber Body Forming Apparatus

Figure 3:
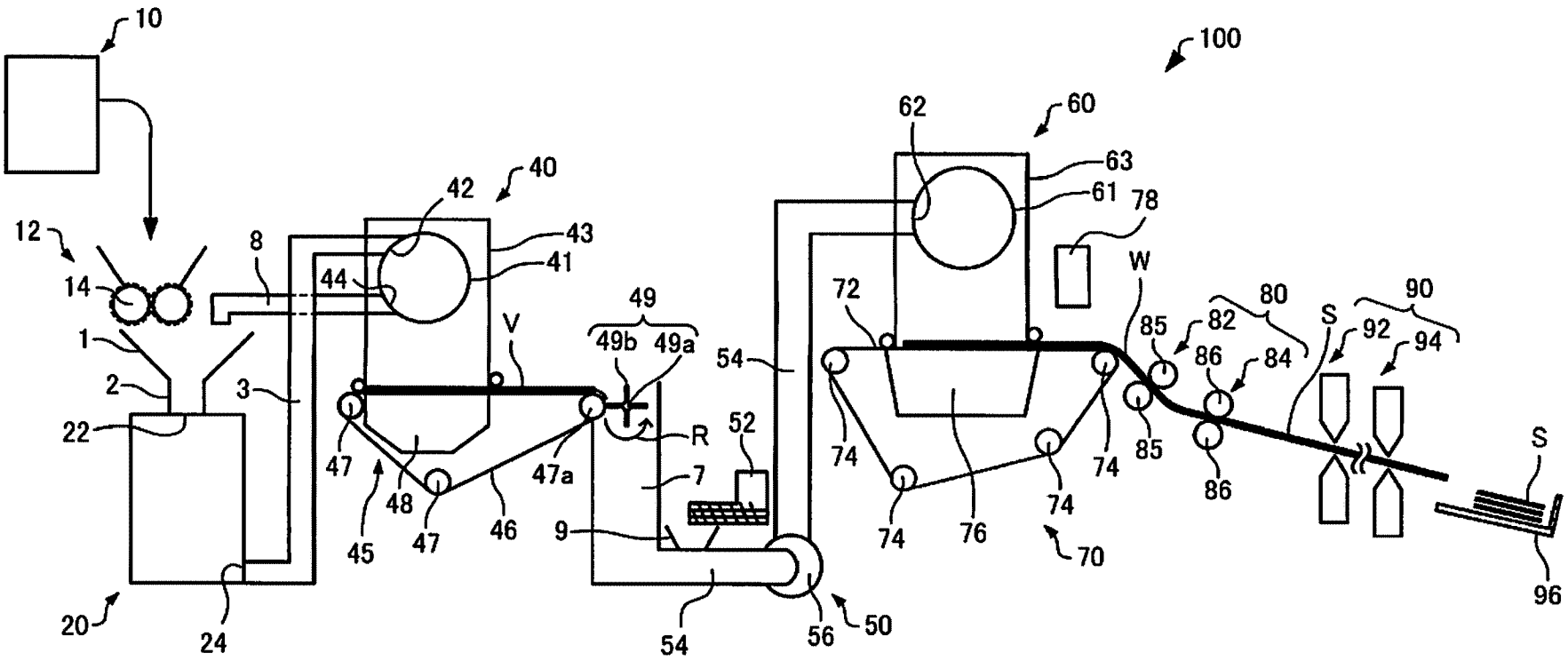
FIG. 3 is a schematic view showing a fiber body forming apparatus.

Next, a fiber body forming apparatus to perform the above fiber body forming method will be described with reference to the drawing. FIG. 3 is a schematic view showing a fiber body forming apparatus 100.

The fiber body forming method according to the first embodiment is performed, for example, using the fiber body forming apparatus 100. In addition, the fiber body forming method according to the first embodiment may also be performed using another apparatus not shown.

As shown in FIG. 3, the fiber body forming apparatus 100 includes a supply portion 10, a coarsely pulverizing portion 12, a defibrating portion 20, a sorting portion 40, a first web forming portion 45, a rotation body 49, a deposition portion 60, a second web forming portion 70, a liquid application device 78, a sheet forming portion 80, and a cutting portion 90.

The supply portion 10 supplies a raw material to the coarsely pulverizing portion 12. The supply portion 10 is, for example, an automatic feed portion continuously feeding the raw material to the coarsely pulverizing portion 12.

The coarsely pulverizing portion 12 cuts the raw material supplied by the supply portion 10 in a gas atmosphere, such as in the air, into small pieces. The small pieces each have a several centimeters square shape. In the example shown in the drawing, the coarsely pulverizing portion 12 has coarsely pulverizing blades 14 and can cut the supplied raw material thereby. As the coarsely pulverizing portion 12, for example, a shredder is used. The raw material cut in the coarsely pulverizing portion 12 is received by a hopper 1 and is then transported to the defibrating portion 20 through a tube 2.

The defibrating portion 20 defibrates the raw material cut in the coarsely pulverizing portion 12. The defibrating portion 20 also has a function to separate substances, such as resin particles, an ink, a toner, and a blurring inhibitor, each of which is adhered to the raw material, from the fibers.

The defibrating portion 20 performs dry defibration. As the defibrating portion 20, for example, an impellor mill is used. The defibrating portion 20 has a function to generate an air stream to suck the raw material and to discharge the defibrated material. Accordingly, the defibrating portion 20 can perform using the air stream generated thereby, a defibration treatment by sucking the raw material from an inlet port 22 together with the air stream and then can transport the defibrated material to a discharge port 24. The defibrated material passing through the defibrating portion 20 is transported to the sorting portion 40 through a tube 3. In addition, as an air stream which transports the defibrated material from the defibrating portion 20 to the sorting portion 40, the air stream generated by the defibrating portion 20 may also be used, or after an air stream generator, such as a blower, is provided, an air stream generated thereby may be used. By the defibrating portion 20, the defibration step described above can be performed.

The sorting portion 40 introduces the defibrated material defibrated in the defibrating portion 20 from an inlet port 42 and then sorts the defibrated material by the length of the fibers. The sorting portion 40 includes a drum portion 41 and a housing portion 43 receiving the drum portion 41. As the drum portion 41, for example, a sieve is used. The drum portion 41 has a net and can sort fibers and/or particles which are smaller than the opening size of this net, that is, a first sorted material passing through the net, and fibers, non-defibrated pieces, and damas which are larger than the opening size of the net, that is, a second sorted material not passing through the net. For example, the first sorted material is transported to the deposition portion 60 through a tube 7. The second sorted material is returned to the defibrating portion 20 from a discharge port 44 through a tube 8. In particular, the drum portion 41 is a cylindrical sieve rotatably driven by a motor. As the net of the drum portion 41, for example, there may be used a metal net, an expanded metal formed by expanding a metal plate provided with cut lines, or a punched metal in which holes are formed in a metal plate by a press machine or the like.

The first web forming portion 45 transports the first sorted material passing through the sorting portion 40 to the deposition portion 60 through the tube 7. The first web forming portion 45 includes a mesh belt 46, tension rollers 47, and a suction mechanism 48.

The suction mechanism 48 can suck the first sorted material which passes through the opening of the sorting portion 40 and which is dispersed in air onto the mesh belt 46. The first sorted material is deposited on the moving mesh belt 46 to form a web V. The basic structures of the mesh belt 46, the tension rollers 47, and the suction mechanism 48 are similar to those of a mesh belt 72, tension rollers 74, and a suction mechanism 76 of the second web forming portion 70 which will be described later.

Since passing through the sorting portion 40 and the first web forming portion 45, the web V is formed so as to be softly expanded with a large amount of air incorporated therein. The web V deposited on the mesh belt 46 is charged in the tube 7.

The rotation body 49 can cut the web V. In the example shown in the drawing, the rotation body 49 includes a base portion 49*a* and protruding portions 49*b* protruding from the base portion 49*a*. The protruding portion 49*b* has, for example, a plate shape. In the example shown in the drawing, four protruding portions 49*b* are provided with regular intervals. When the base portion 49*a* is rotated in a direction R, the protruding portions 49*b* can be rotated around the base portion 49*a*. Since the web V is cut by the rotation body 49, for example, the change in amount of the defibrated material per unit time to be supplied to the deposition portion 60 can be reduced.

The rotation body 49 is provided in the vicinity of the first web forming portion 45. In the example shown in the drawing, the rotation body 49 is provided in the vicinity of a tension roller 47*a* located downstream in a path of the web V. The rotation body 49 is provided at a position at which the protruding portion 49*b* can be brought into contact with the web V and cannot be brought into contact with the mesh belt 46. Accordingly, the mesh belt 46 can be suppressed from being abraded by the protruding portions 49*b*. The shortest distance between the mesh belt 46 and the protruding portion 49*b* is, for example, 0.05 to 0.5 mm. This is a distance at which the web V can be cut without causing damage on the mesh belt 46.

After the deposition portion 60 introduces the first sorted material from an inlet port 62, the entangled defibrated material, that is, the fibers, are disentangled and allowed to fall down while being dispersed in air. Accordingly, the deposition portion 60 is able to deposit the first sorted material on the second web forming portion 70.

The deposition portion 60 includes a drum portion 61 and a housing portion 63 receiving the drum portion 61. As the drum portion 61, a rotatable cylindrical sieve is used. The drum portion 61 has a net and allows fibers and/or particles which are smaller than the opening size of the net to fall down. The structure of the drum portion 61 is, for example, the same as that of the drum portion 41. By the deposition portion 60, the above web forming step can be performed.

In addition, the "sieve" of the drum portion 61 may not have a function to sort a specific object. That is, the "sieve" to be used as the drum portion 61 indicates a member provided with a net, and the drum portion 61 may allows all of the mixture introduced thereinto to fall down.

The second web forming portion 70 deposits a passing material passing through the deposition portion 60 to form a web W. The second web forming portion 70 includes, as described above, the mesh belt 72, the tension rollers 74, and the suction mechanism 76.

While being transferred, the mesh belt 72 allows the passing material passing through the opening of the deposition portion 60 to deposit. The mesh belt 72 is stretched by the tension rollers 74 and has the structure in which air is supplied so that the passing material is not likely to pass. The mesh belt 72 is transferred by the rotation of the tension rollers 74. While the mesh belt 72 is continuously transferred, the passing material passing through the deposition portion 60 is allowed to continuously fall down and deposit, so that the web W is formed on the mesh belt 72. The mesh belt 72 is formed, for example, of a metal, a resin, a cloth, or a non-woven cloth.

The suction mechanism 76 is provided under the mesh belt 72. The suction mechanism 76 can generate a downward air stream. By the suction mechanism 76, the mixture dispersed in air by the deposition portion 60 can be sucked on the mesh belt 72. Accordingly, a discharge rate from the deposition portion 60 can be increased. Furthermore, by the suction mechanism 76, a downflow can be formed in a path in which the mixture falls, and the defibrated materials are prevented from being entangled during the falling.

As described above, since passing through the deposition portion 60 and the second web forming portion 70, the web W can be formed so as to be softly expanded with a large amount of air incorporated therein. The web W deposited on the mesh belt 72 is transported to the sheet forming portion 80.

The liquid application device 78 applies the liquid described in the above "1.3.1. LIQUID" on the web W. The liquid application device 78 is, for example, an ink jet head. By the liquid application device 78, the above liquid application step can be performed.

The sheet forming portion 80 forms a sheet S by pressure heating of the web W to which the liquid is applied. The sheet forming portion 80 can bind the fibers with the thermoplastic resin by applying heat to the web W to which the liquid is applied.

The sheet forming portion 80 includes a pressure application portion 82 pressuring the web W and a heating portion 84 heating the web W pressurized by the pressure application portion 82. The pressure application portion 82 is formed of a pair of calendar rollers 85 and applies a pressure to the web W. Since the web W is pressurized, the thickness thereof is decreased, and the density of the web W is increased. In the example shown in the drawing, the heating portion 84 includes a pair of heating rollers 86. Since the heating portion 84 is formed of the heating rollers 86, compared to the case in which the heating portion 84 is formed as a plate-shaped press machine, the sheet S can be formed while the web W is continuously transported. The calendar rollers 85 and the heating rollers 86 are disposed, for example, so that the rotation shafts thereof are in parallel to each other. In this case, the calendar rollers 85 can apply a higher pressure to the web W than that to be applied to the web W by the heating rollers 86. In addition, the number of the calendar rollers 85 and the number of the heating rollers 86 are not particularly limited. By the pressure application portion 82, the above pressure application step can be performed. By the heating portion 84, the above fiber body forming step can be performed.

The cutting portion 90 cuts the sheet S formed by the sheet forming portion 80. In the example shown in the drawing, the cutting portion 90 includes a first cutting portion 92 cutting the sheet S in a direction intersecting the transportation direction of the sheet S and a second cutting portion 94 cutting the sheet S in the direction in parallel to the transportation direction. The second cutting portion 94 cuts, for example, the sheet S passing through the first cutting portion 92.

Accordingly, a single sheet S having a predetermined size is formed. The single sheet S thus cut is discharged to a discharge portion 96.

In addition, the fiber body forming method according to the second embodiment may also be performed using the fiber body forming apparatus 100. In the case of the fiber body forming method according to the second embodiment, the liquid is not applied from the liquid application device 78, and a thermoplastic resin powder is supplied from an additive supply portion 52 of a mixing portion 50. Hereinafter, the method will be described in detail.

The mixing portion 50 mixes the first sorted material passing through the sorting portion 40 and additives containing a thermoplastic resin. The mixing portion 50 includes an additive supply portion 52 supplying the additives, a tube 54 transporting the first sorted material and the additives, and a blower 56. In the example shown in the drawing, the additives are supplied from the additive supply portion 52 to the tube 54 through a hopper 9. The tube 54 is coupled to the tube 7.

In the mixing portion 50, an air stream is generated by the blower 56, and the first sorted material and the additives can be transported through the tube 54 while being mixed with each other. In addition, a mechanism to mix the first sorted material and the additives is not particularly limited, and for example, a mechanism in which stirring is performed by at least one high speed rotational blade or a mechanism, such as a V-type mixer, which uses rotation of a container may be used.

As the additive supply portion 52, a screw feeder as shown in FIG. 4 or a disc feeder not shown may be used. The additives to be supplied from the additive supply portion 52 may include the thermoplastic resin described in the above "1.3.1. LIQUID". When the thermoplastic resin is supplied, the fibers are not bound to each other. The resin is melted when passing through the sheet forming portion 80, so that the fibers are bound together. By the mixing portion 50, the above mixing step can be performed.

4. Examples and Comparative Examples

4.1. Preparation of Sample

Samples of Examples 1 to 5 and Comparative Examples 1 to 3 were prepared. FIG. 4 is a table showing the components of the samples of Examples 1 to 5 to Comparative Examples 1 to 3. The numerical unit in the table indicates percent by mass. The samples of Examples 1 to 4 to Comparative Examples 1 to 3 were each a liquid containing a resin, and the total was represented by 100 percent by mass by addition of water as the balance. In addition, as "glycerin" and "propylene glycol" in the table, commercially available reagents were used, and the other components were as shown below.

- Resin 1: Superflex 130 (polyurethane, manufactured by DKS Co., Ltd.)
- Resin 2: Superflex 170 (polyurethane, manufactured by DKS Co., Ltd.)
- Resin 3: Elitele KA3556 (polyester, manufactured by Unitika Ltd.)
- Resin 4: FP-3000A (acrylic resin, manufactured by Showa Denko K.K.)
- Resin 5: FS102 (styrene-acrylic resin, manufactured by Nippon Paint Industrial Coatings Co., Ltd.)
- Resin 6: APP-84 (carboxymethyl cellulose, manufactured by Nippon Paper Industries Co., Ltd.)
- Olfine E1010 (manufactured by Nisshin Chemical Industry Co., Ltd.)
- Surfynol 104PG50 (manufactured by Nisshin Chemical Industry Co., Ltd.)

In Example 5, moisture was removed from a liquid containing the resin 1 by freeze dehydration, so that a solid component of the resin 1 was prepared. This solid component was pulverized by a hammer mill "Labomill LM-05" manufactured by Dalton Corporation) and a jet mill "PJM-80SP" manufactured by Nippon Pneumatic Mfg. Co., Ltd. and was further classified by an airflow classifier "MDS-3" manufactured by Nippon Pneumatic Mfg. Co., Ltd. As a result, a resin powder was obtained.

By the use of the samples of Examples 1 to 5 and Comparative Examples 1 to 3, the Tg of the resin, the viscosity of the liquid, and the average particle diameter of the resin were measured. The Tg was measured using a differential scanning calorimeter (DSC) "Q1000" manufactured by TA Instruments Inc.). The viscosity was measured at a temperature of 25° C. and a revolution rate of 100 rpm using an E type viscometer "TV-25" manufactured by Toki Sangyo Co., Ltd.). The average particle diameter was measured using a particle size distribution meter "Nanotrac Wave II-EX150" manufactured by MicrotracBell, and the D50 value obtained by the measurement was regarded as the average particle diameter.

Next, paper making was performed using the samples of Examples 1 to 5 and Comparative Examples 1 to 3.

In Examples 1 to 4 and Comparative Examples 1 to 3, a recycle cut version PPC (Plain Paper Copier) sheet "G80" manufactured by Toppan Forms Co., Ltd. was defibrated by a self-made dry defibrating machine to form a web. To the web thus formed, the liquids of Examples 1 to 4 and Comparative Examples 1 to 3 were each applied by an ink jet printer (PX-S160T modified machine, manufactured by Seiko Epson Corporation). Subsequently, heating was performed by a heating roller machine, so that paper having an A4 size was made.

In Example 5, fibers defibrated by the self-made dry defibrating machine and the resin powder obtained as described above were charged in a blender "Waring Blender 712 model" manufactured by Waring, followed by mixing at a revolution rate of 3,100 rpm for 7 seconds, so that a mixture was obtained. Subsequently, the mixture was charged to a sieve having an opening size of 0.6 mm and a diameter of 200 mm and was then deposited on a fluorine-resin coated aluminum disc having a diameter of 180 mm and a plate thickness of 1 mm using an electric vibratory sieve shaker. As the fluorine-resin coated aluminum disc, "Sumiflon coated aluminum" manufactured by Sumitomo Electric Fine Polymer, Inc. was used. As the electric vibratory sieve shaker, "AS200" manufactured by Retsch was used. After a fluorine-resin coated aluminum disc having the same diameter as that of the disc described above was placed on the mixture thus deposited, the mixture was compressed by pressure application. After being sandwiched between the aluminum discs, the mixture was set in a heat press device and was maintained for 60 seconds, and next, the mixture sandwiched between the discs was recovered from the heat press device and was then left until the temperature reached room temperature. Subsequently, the mixture thus formed was peeled away from the aluminum discs, so that a sheet having an A4 size was obtained. In addition, "20 percent by mass" of Example 5 in FIG. 4 indicates that when the amount of the sheet thus prepared is regarded as 100 percent by mass, the content of the resin is 20 percent by mass.

Next, by the use of the sheet thus prepared in each of Examples 1 to 5 and Comparative Examples 1 to 3, a storage elastic modulus at 100° C. and a storage elastic modulus at 150° C. were measured. For the measurement of the storage elastic modulus, Dynamic Mechanical Analysis (DMA) (model No. DMA 242 E Artemis, manufactured by NETZSCH) was used. The sheet thus prepared as the sample was cut into a rectangular shape having a length of 10 mm and a width of 4 mm, and the storage elastic modulus was measured at a vibration frequency of 1 Hz, a measurement temperature of 25° C. to 200° C., and a temperature increase rate of 3° C./min.

4.2. Evaluation

By the use of the sample sheet thus prepared in each of Examples 1 to 5 and Comparative Examples 1 to 3, a curling property and ink jet applicability were evaluated.

For the evaluation of the curling property, 100 sheets were allowed to pass through a printer.

The evaluation criteria of the curling property are as follows.

A: No curling is generated in 100 sheets.

B: Curling is generated in at least one sheet.

The ink jet applicability was evaluated using an ink jet printer PX-S160T modified machine (manufactured by Seiko Epson Corporation) by an ejection frequency at which liquid droplets each having a volume of 40 pl could be stably and continuously ejected at an ejection rate of 10 m/s.

The evaluation criteria of the ink jet applicability are as follows.

A: A frequency of 20 kHz or more

B: A frequency of 5 to less than 20 kHz

The evaluation results of the curling property and the ink jet applicability are shown in FIG. 4.

As shown in FIG. 4, in Examples 1 to 5, the curling property was evaluated as "A", and the curling was not generated. On the other hand, in Comparative Examples 1 to 3, the curling property was evaluated as "B", and the curling was generated. Hence, it is found that when the storage elastic modulus at 100° C. is 600 MPa or more, and the storage elastic modulus at 150° C. is 400 MPa or more, the curling is not likely to occur.

In Example 4, since the amount of the resin was large as compared to that in each of Examples 1 to 3, the viscosity was high. Hence, the ink jet applicability was evaluated as "B".

In the present disclosure, within the scope including the features and the effects described in the present application, the structure may be partially omitted, and/or the embodiments and modified examples may be arbitrarily combined with each other.

The present disclosure is not limited to the embodiments described above and may be variously changed and/or modified. For example, the present disclosure includes substantially the same structure as the structure described in the embodiment. The substantially the same structure includes, for example, the structure in which the function, the method, and the result are the same as those described above, or the structure in which the object and the effect are the same as those described above. In addition, the present disclosure includes the structure in which a nonessential portion of the structure described in the embodiment is replaced with something else. In addition, the present disclosure includes the structure which performs the same operational effect as that of the structure described in the embodiment or the structure which is able to achieve the same object as that of the structure described in the embodiment. In addition, the present disclosure includes the structure in which a known technique is added to the structure described in the embodiment.

What is claimed is:

1. A fiber body forming method comprising:

defibrating a raw material containing fibers to form a defibrated material;

depositing the defibrated material to form a web;

applying a liquid containing a thermoplastic resin which binds the fibers to the web, the thermoplastic resin having an average particle diameter of 100 nm or less, and the content of the thermoplastic resin in the liquid being 5 to 15 percent by mass; and heating the web to which the liquid is applied, to form a fiber body that is a sheet in which the fibers are bound with the thermoplastic resin, the fiber body including respective storage elastic modulus of 400 MPa or more, or 600 MPa or more at respective 150° C. or 100° C.

2. The fiber body forming method according to claim 1, wherein in the applying the liquid, the liquid is applied by an ink jet method.

3. The fiber body forming method according to claim 1, wherein the applying of the liquid is performed by applying the liquid that has a viscosity of 5.0 to 10.0 m·Pas at 25° C.

4. The fiber body forming method according to claim 1, wherein the applying of the liquid is performed by applying the liquid that contains the thermoplastic resin having a glass transition temperature of 75° C. to 120° C.

5. The fiber body forming method according to claim 1, wherein the applying of the liquid is performed by applying the liquid which contains the thermoplastic resin selected from a polyurethane and a polyester.

6. A fiber body forming method comprising:

defibrating a raw material containing fibers to form a defibrated material;

mixing the defibrated material and a thermoplastic resin which binds the fibers to form a mixture, the thermoplastic resin having an average particle diameter of 100 nm or less;

depositing the mixture to form a web; and heating the web to form a fiber body that is a sheet in which the fibers are bound with the thermoplastic resin, the fiber body including respective storage elastic modulus of 400 MPa or more, or 600 MPa or more at respective 150° C. or 100° C.

* * * * *